US009994367B2

(12) United States Patent
Hatamian et al.

(10) Patent No.: US 9,994,367 B2
(45) Date of Patent: Jun. 12, 2018

(54) CONTAINER STOPPER AND OPENER

(71) Applicants: Mehdi Hatamian, Dove Canyon, CA (US); Kamran Ghobadi, Irvine, CA (US)

(72) Inventors: Mehdi Hatamian, Dove Canyon, CA (US); Kamran Ghobadi, Irvine, CA (US)

( * ) Notice: Subject to any disclaimer, the term of this patent is extended or adjusted under 35 U.S.C. 154(b) by 425 days.

(21) Appl. No.: 14/751,712

(22) Filed: Jun. 26, 2015

(65) Prior Publication Data

US 2016/0355302 A1 Dec. 8, 2016

Related U.S. Application Data

(60) Provisional application No. 62/169,944, filed on Jun. 2, 2015.

(51) Int. Cl.
*B65D 39/12* (2006.01)

(52) U.S. Cl.
CPC ..... *B65D 39/12* (2013.01); *B65D 2539/005* (2013.01)

(58) Field of Classification Search
CPC ... B65D 39/12; B65D 39/16; B65D 2539/005
USPC ..... 53/489; 215/358, 360
See application file for complete search history.

(56) References Cited

U.S. PATENT DOCUMENTS 456,257 A * 7/1891 Haigh ..... B65D 39/12 215/360
605,125 A * 6/1898 Nutt ..... B65D 39/12 215/360
1,416,278 A * 5/1922 Furman ..... B65D 39/12 215/360
1,455,978 A * 5/1923 Wentz ..... B65D 39/12 215/360
2,633,763 A * 4/1953 Sperling ..... B23B 47/28 269/49
2,732,106 A * 1/1956 Harland ..... B65D 39/12 215/360
3,213,845 A * 10/1965 Blahut et al. ..... B24B 53/04 125/11.15

(Continued)

FOREIGN PATENT DOCUMENTS

CA 2203075 11/1997
CA 2391208 5/2002

(Continued)

*Primary Examiner* — Stephen F Gerrity
(74) *Attorney, Agent, or Firm* — Bruce Hare; Genius Patent APC

(57) ABSTRACT

A bottle stopper includes: a cylindrical guide having multiple slits that run parallel to a center axis along a portion of the guide; a cylindrical nut that is able to move along the center axis, the nut including multiple ridges, each ridge engaging a particular slit such that the nut is not able to rotate relative to the guide about the center axis; a knob coupled to a threaded bolt; and a set screw that secures the knob relative to the guide such that the guide and the knob move together as a rigid body along the center axis, where the threaded bolt is able to engage the nut such that the nut is moved along the center axis when the knob is rotated about the center axis. A method of sealing a container includes: inserting a plug and stopper; and rotating a knob to reach a specified sealing pressure.

21 Claims, 9 Drawing Sheets

(56) References Cited

U.S. PATENT DOCUMENTS

| | | | | |
|---|---|---|---|---|
| 5,334,213 | A * | 8/1994 | Price, Jr. | A61F 2/142 606/166 |
| 6,536,618 | B1 | 3/2003 | Hwang et al. | |
| 8,123,054 | B2 | 2/2012 | Smith et al. | |
| 9,010,556 | B2 | 4/2015 | Benson | |
| 2003/0168424 | A1* | 9/2003 | Permuy | B65D 39/12 215/360 |
| 2004/0112856 | A1* | 6/2004 | Hwang et al. | B65D 39/12 215/361 |
| 2015/0060389 | A1 | 3/2015 | Bolger | |
| 2017/0275057 | A1* | 9/2017 | Gonzalez Valencia et al. | B65D 39/12 |

FOREIGN PATENT DOCUMENTS

| | | | | |
|---|---|---|---|---|
| CN | 2515133 | | 10/2002 | |
| DE | 3231140 | A1 * | 2/1984 | B65D 39/12 |
| DE | 102007028158 | | 6/2008 | |
| FR | 395770 | A * | 3/1909 | B65D 39/12 |
| FR | 549245 | A * | 2/1923 | B65D 39/12 |
| FR | 2594501 | A1 * | 8/1987 | B65D 39/12 |
| GB | 414254 | A * | 8/1934 | B65D 39/12 |
| GB | 1276485 | A * | 6/1972 | B65D 39/12 |
| JP | 2000016444 | | 1/2000 | |
| JP | 2000065025 | A | 3/2000 | |

* cited by examiner

CONTAINER STOPPER AND OPENER

CROSS REFERENCE TO RELATED APPLICATIONS

The present patent application is a formalization of a previously filed provisional patent application entitled "Cork," filed Jun. 2, 2015, as U.S. patent application Ser. No. 62/169,944 by the inventor(s) named in this application. This patent application claims the benefit of the filing date of the cited provisional patent application according to the statutes and rules governing provisional patent applications, particularly 35 USC § 119 and 37 CFR § 1.78. The specification and drawings of the cited provisional patent application are specifically incorporated herein by reference.

COPYRIGHT

A portion of the disclosure of this patent document contains material which is subject to copyright protection. The owner has no objection to the facsimile reproduction by anyone of the patent disclosure, as it appears in the Patent and Trademark Office files or records, but otherwise reserves all copyright rights whatsoever.

FIELD OF INVENTION

This invention is related to a stopper for a container where rotating the stopper causes tightening/loosening of same. In particular, the stopper comprises an actuating member which travels along an axial direction of the stopper inside a pressure inducing member which in turn expands/contracts within a mouth of the container.

BACKGROUND

The present invention seeks to provide a stopper which can be inserted into the mouth of a container and whose pressure against the mouth can be controlled by rotating the stopper's knob in either circumferential direction. The stopper includes a nut which can move up and down the axial direction within a guide member included in the stopper. The guide includes several prongs which expand and contract as the nut travels up and down the guide. The stopper further includes a plug whose outer surface is in contact with the mouth of the container and whose inner surface houses the guide member. As the prongs expand and contract they increase and decrease the radial pressure caused by the plug against the mouth of the container.

The mechanism which will be described in full detail below comprises a knob including a threaded bolt at one end, a guide with a tapered inside surface and several prongs, and a special nut with grooves around its perimeter to travel up and down the guide. This assembly is embedded inside a plug included in the stopper. The guide presses against the sidewalls of the plug from inside. When the knob is turned clock-wise the nut is pulled upwards toward the top and gradually opens up the prongs of the guide due to the tapered inner surface of the guide, exerting more and more pressure on the inside wall of the plug as it goes up. Depending on the bottle and the container, the outside diameter of the plug containing the assembly is such that the plug easily fits in the bottle's mouth (or the container's mouth) with very small amount of pressure (just enough so that it doesn't fall into the bottle or container). Once the stopper is placed, turning the knob clock-wise will apply pressure from inside the plug as described above and seals the container. Likewise, by turning the knob in the opposite direction the pressure applied from inside the plug is removed and the plug is loosened and removed to open the bottle or container.

One non-limiting but very specific application of this new stopper is for sealing wine bottles. The wine industry and wine manufacturers across the world use only cork material as the plug for sealing their bottles and do not accept any other material. They can use this new stopper on the bottle which from the point of view of touching the wine and the sealing surface against the bottle's glass is the same as what they are used to with the added advantage that the consumer can easily open the bottle by turning the top knob without the need for a wine opener device. Furthermore, after a partial use of the wine content in the bottle, the consumers can reuse the stopper to seal the bottle in exactly the same way as it was done originally when the wine was made and bottled. Even if the wine bottle uses the conventional cork that is opened with a wine opener, the consumers can still use the stopper of the present invention after opening the bottle to save the content.

Wine and champagne bottles use stoppers made from cork material. Because of the cellular structure of cork, it is easily compressed upon insertion into a bottle and will expand to form a tight seal. The interior diameter of the neck of glass bottles tends to be inconsistent, making this ability to seal through variable contraction and expansion an important attribute. Although other types of closures such as synthetic plastic stoppers and screw caps have been used, cork remains the choice stopper for wine and champagne manufacturers. In fact, in some countries screw caps are often seen as a cheap alternative destined only for the low grade wines.

Corkscrews are the only practical equipment that can be used to open a wine or champagne bottle. Furthermore, it is common occurrence that the use of corkscrew damages the cork stopper during opening. This is usually caused by improper insertion of the corkscrew into the cork stopper and/or misalignment between the corkscrew axis and cork stopper axis. Accordingly, there is a need for a stopper for a container whose sealing pressure can be controlled and which eliminates the need for a separate apparatus for opening the stopper.

Although various stoppers have been proposed which touch upon some aspects of the above problems, they do not provide solutions to the existing limitations in providing stoppers for containers with controllable sealing pressure. For example, Smith et al., U.S. Pat. No. 8,123,054 entitled "Dispensing Caps for Beverage Containers" discloses a drinking cap which includes a first tubular portion for connection to the mouth of a beverage container and an elongate actuating member situated at least partly within the first tubular portion and connected to it by a resilient, annular, integral web in which one or more flow openings are formed. The actuating member is longitudinally movable in the axial direction between an open position of the flow openings and a closed position thereof. The cap also includes an insert and a piston which together define a reservoir. The insert includes a cylindrical wall and a portion which is movable under the action of pressure within the reservoir and in which a discharge aperture is formed. A flow tube is connected to the piston around an aperture and extends through the discharge aperture in the insert and forms a sliding seal with the edge of the discharge aperture. The actuating member is arranged to engage the piston when it is moved from the closed position to the open position and thus to move the piston towards the insert, whereby the increased pressure created in the reservoir causes the movable portion of the insert to move away from the piston until the flow tube moves out of the discharge aperture in the insert.

The Int. App. Pub. No. W09520527A1 to Smith entitled "Sealing Cap for Containers" discloses a multiple cap arrangement which is provided to seal the open end of a container. The multiple cap seal includes a sealing cap and a locking cap that are attached by a hinge. The sealing cap is a cup shaped member with a frustoconical side wall and a convex end wall that bulges in a direction away from the open end of the cup member when the sealing cap is inserted into the container. As the pressure inside the container increases, the convex end wall deflects and flattens causing the frustoconical side wall of the cup shaped member to expand radially outward and enhance the seal between the sealing cap and the container. The locking cap is provided to prevent the overdeflection of the convex end wall of the sealing cap.

The Canadian Pat. App. No. CA 2,203,075 to Goglio entitled "Anti-Spill Device for Liquid Containers" discloses an anti-spill device for liquid containers, in particular for dense or viscous liquids, consisting of a cup-shaped element or under-cap, of elastic material, inserted in the spout of the container and forming a liquid seal, withstanding a pressure at least equal to the pressure exerted by the weight of the liquid held in the container on said cup-shaped element, so that the container can be overturned without there being any separation of the under-cap, which occurs only following an increase in the pressure inside the container, caused for example by squeezing the side wall thereof, the under-cap being connected, by means of a rod-shaped extension to radial elastic fins, such as to avoid complete detachment of the anti-spill device from the container.

The present invention is a new stopper for a container which includes components facilitating control over the sealing pressure. The components include an actuating nut which moves up and down along the length of a guide within a plug. The plug can readily be inserted inside the mouth of the container and the knob of the stopper can be rotated in either direction to control the sealing pressure of the plug against the container mouth

SUMMARY

In one aspect, a stopper for a container is disclosed wherein the stopper comprises, a substantially cylindrical plug operative to engage a mouth of the container, said plug comprising a blind hole having a first depth along an axial direction of the plug thereby defining a plug inner surface having a plug inner diameter and a plug inner height, a plug outer surface having a plug outer diameter and a plug outer height, and a plug base having a plug thickness, a substantially tubular guide operative to engage the plug inner surface, said guide having a guide outer surface, a guide height, and a guide inner surface wherein the guide inner surface is tapered along the axial direction, said guide comprising two or more slits having a second depth along the axial direction thereby defining two or more guide prongs, a substantially cylindrical nut operative to engage the guide inner surface, said nut having a nut outer surface, a nut height, and a nut inner surface wherein the nut inner surface is threaded along the axial direction, said nut comprising two or more grooves along the axial direction, said two or more grooves operative to engage the two or more guide prongs, and a substantially cylindrical knob comprising a threaded bolt having a bolt height, said bolt operative to engage the nut, wherein the nut moves upwardly toward the knob in the axial direction along the guide inner surface thereby expanding the two or more guide prongs when the knob is rotated in a circumferential direction around the axial direction, and wherein the nut moves downwardly away from the knob in the axial direction along the guide inner surface thereby contracting the two or more guide prongs when the knob is rotated opposite to the circumferential direction.

Preferably, the guide outer surface further comprises at least one circumferential ridge along the axial direction.

Preferably, the stopper further comprises at least one setscrew operative to secure the knob to the guide so that the knob and the guide move together as a rigid body along the axial direction.

Preferably, the guide is molded in the plug. Preferably, the plug outer diameter is equal to or greater than an inner diameter of the mouth. Preferably, the plug inner height is equal to or greater than the guide height. Preferably, a guide outer diameter of the guide outer surface is equal to or greater than the plug inner diameter. Preferably, the bolt height is equal to the guide height. Preferably, diameter of the knob is equal to an outer diameter of the mouth. Preferably, the plug is made from cork material. Preferably, guide is made from one of aluminum and steel material. Preferably, the container is one of wine and champagne bottle.

In another aspect, a method of sealing a container is disclosed wherein the method comprises providing a substantially cylindrical plug operative to engage a mouth of the container, said plug comprising a blind hole having a first depth along an axial direction of the plug thereby defining a plug inner surface having a plug inner diameter and a plug inner height, a plug outer surface having a plug outer diameter and a plug outer height, and a plug base having a plug thickness, providing a substantially tubular guide operative to engage the plug inner surface, said guide having a guide outer surface, a guide height, and a guide inner surface wherein the guide inner surface is tapered along the axial direction, said guide comprising two or more slits having a second depth along the axial direction thereby defining two or more guide prongs, providing a substantially cylindrical nut operative to engage the guide inner surface, said nut having a nut outer surface, a nut height, and a nut inner surface wherein the nut inner surface is threaded along the axial direction, said nut comprising two or more grooves along the axial direction, said two or more grooves operative to engage the two or more guide prongs, and providing a substantially cylindrical knob comprising a threaded bolt having a bolt height, said bolt operative to engage the nut, wherein the nut moves upwardly toward the knob in the axial direction along the guide inner surface thereby expanding the two or more guide prongs when the knob is rotated in a circumferential direction around the axial direction, and wherein the nut moves downwardly away from the knob in the axial direction along the guide inner surface thereby contracting the two or more guide prongs when the knob is rotated opposite to the circumferential direction.

Preferably, the method further comprises providing at least one circumferential ridge on the guide outer surface along the axial direction.

Preferably, the method further comprises providing at least one setscrew operative to secure the knob to the guide so that the knob and the guide move together as a rigid body along the axial direction.

DETAILED DESCRIPTION OF THE PRESENTLY PREFERRED EMBODIMENTS

Figure 1A:
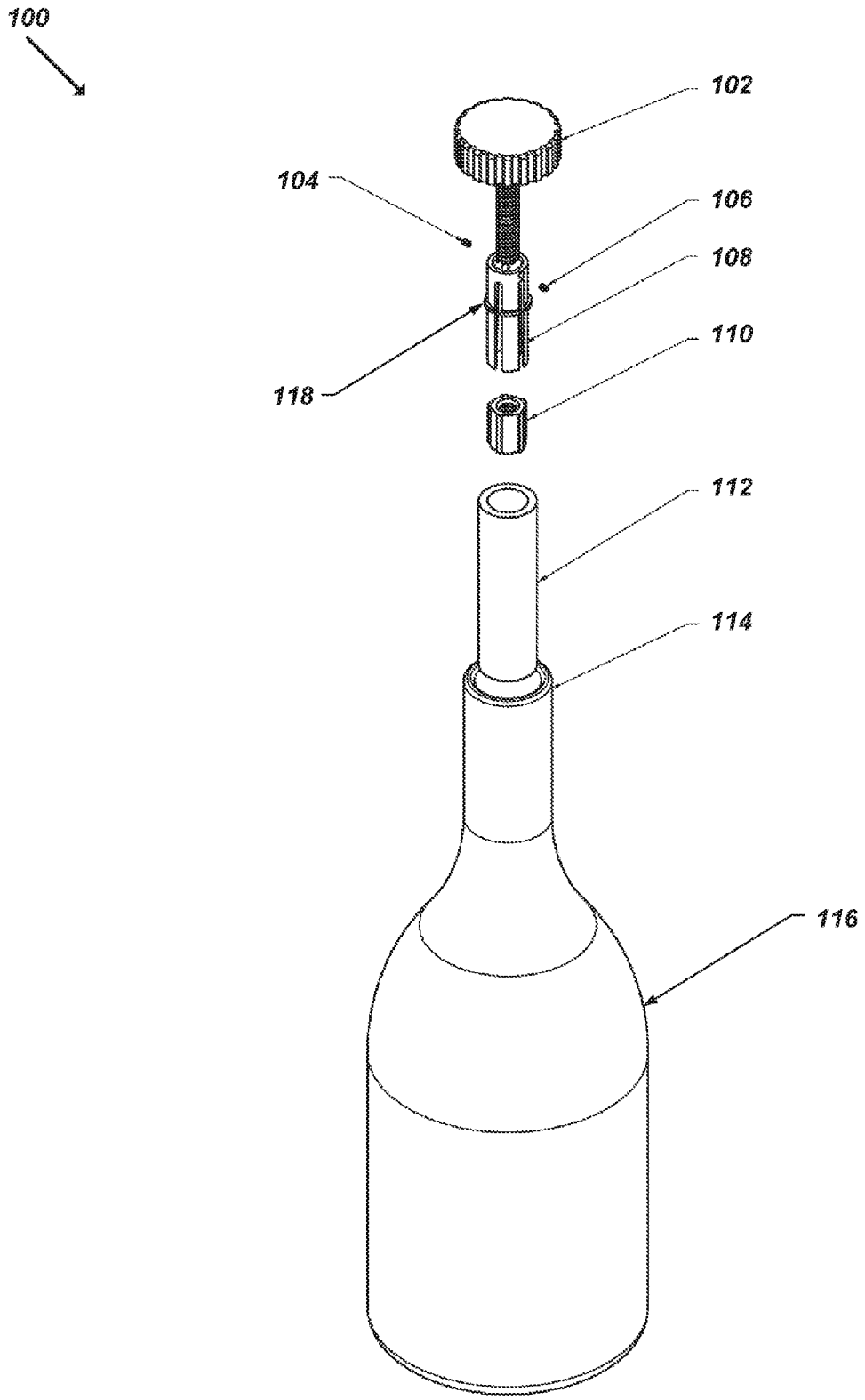
FIG. 1A shows an exploded view of a preferred embodiment of a stopper and its components for a container.
Figure 1B:
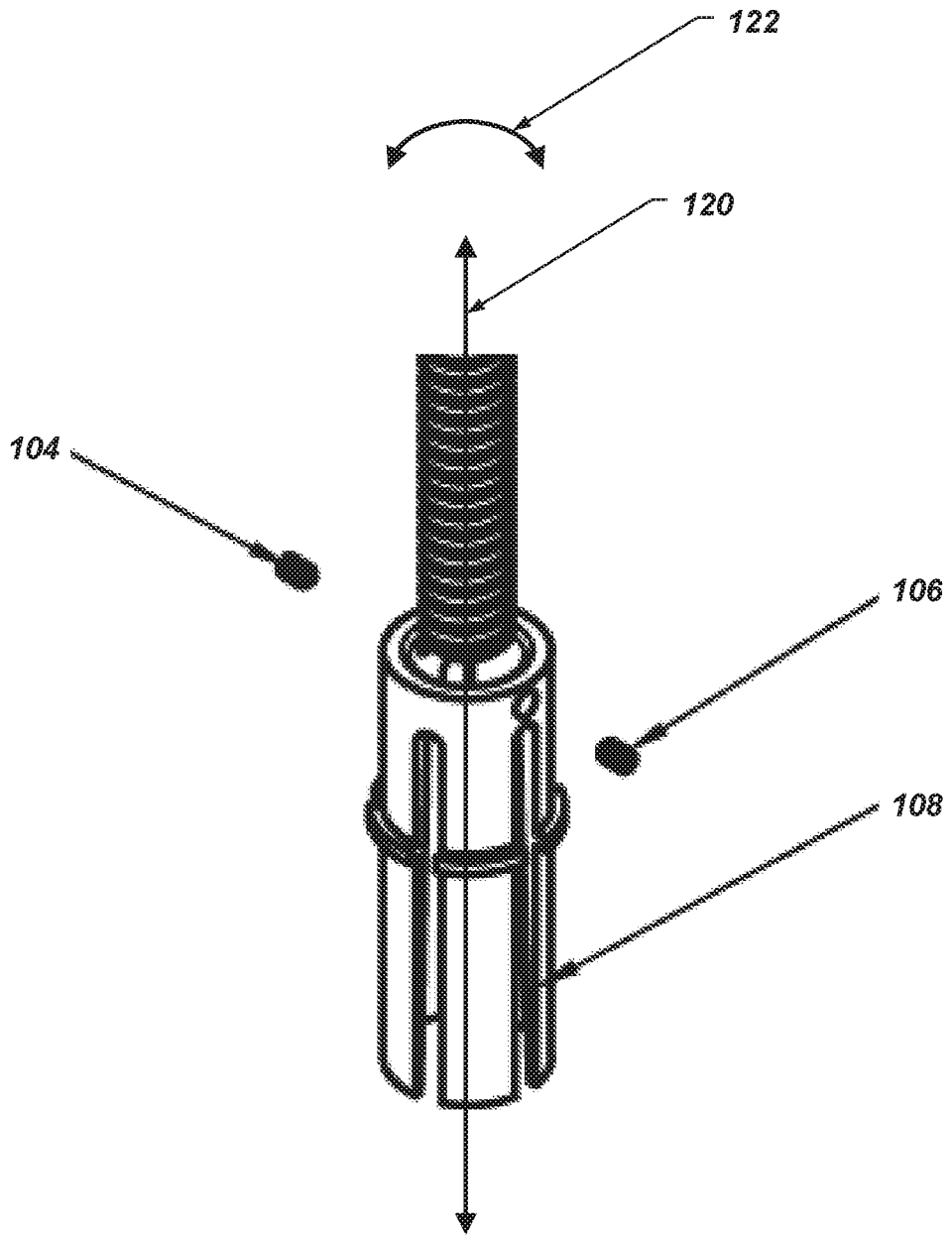
FIG. 1B shows a close up view of the guide and setscrews included in the stopper according to the present invention.

FIG. 1A depicts a diagram 100 of an exploded view of a preferred embodiment of a stopper comprising a substantially cylindrical plug 112, a substantially tubular guide 108, a substantially cylindrical nut 110, and a substantially cylindrical knob 102. In this preferred embodiment, the stopper further comprises two setscrews 104 and 106 and a circumferential ridge 118. A partial view of the stopper assembly is also shown in FIG. 1B to clearly show the two setscrews 104 and 106 and the guide 108 which includes the ridge 118. The stopper of the present invention is provided to seal a container 116 which in this preferred embodiment is depicted as a wine bottle. The plug 112 operates to engage a mouth 114 of the container 116 to seal the container 116.

The stopper seals the container 116 via the plug 112 whose sealing pressure against the mouth 114 can be controlled. Specifically, the nut 110 in inserted in the plug 112. The guide 108 is inserted in the plug 112 and the knob 102 which comprises a threaded bolt (shown in more detail in FIG. 4A-FIG. 4C) is inserted in the guide 108. The threaded bolt engages the nut 110 which moves up and down in an axial direction 120 along the axial direction of the container 116 when the knob 102 is rotated in either circumferential direction 122. The guide 108 comprises prongs (shown in more detail in FIG. 5A-FIG. 5F) which engage the grooves of the nut 110 (shown in more detail in FIG. 3A-FIG. 3D). The inner surface of the guide 108 (shown in more detail in FIG. 5A-FIG. 5F) is tapered along the axial direction 120. As the knob 102 is rotated, for instance clockwise, in the circumferential direction 122, the nut 110 moves up along the axial direction 120 and the prongs of the guide 108 expand which increase the radial pressure caused by the plug 112 against the mouth 114 of the container 116. As the knob 102 is rotated counterclockwise in the circumferential direction 122, the nut 110 moves down along the axial direction 120 and the prongs of the guide 108 contract which decrease the radial pressure caused by the plug 112 against the inner surface of the mouth 114 of the container 116. In this preferred embodiment, the stopper includes two setscrews 104 and 106 which are inserted in the guide 108 to secure the knob to the guide so that the knob 102 and the guide 108 move together as a rigid body along the axial direction 120 while allowing the knob 102 to freely rotate in either direction along the circumferential direction 122 inside the guide 108. In this preferred embodiment, the guide 108 includes the ridge 118 to rigidly secure the guide 108 to the plug 112 so that the guide 108 and the plug 112 move as a rigid body along the axial direction 120 and the circumferential direction 122.

Figure 2A:
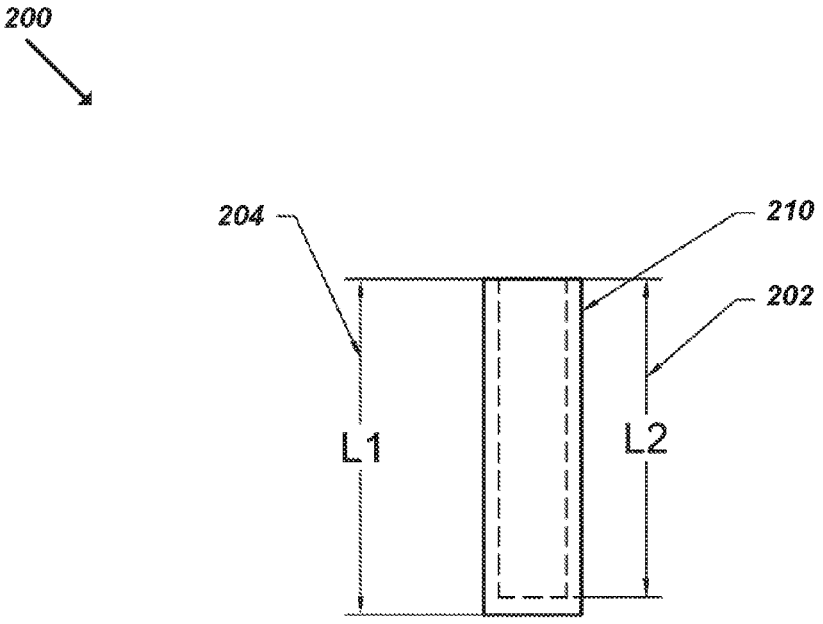
FIG. 2A shows a front elevation view of a preferred embodiment of a plug included in the stopper shown in FIG. 1A.
Figure 2B:
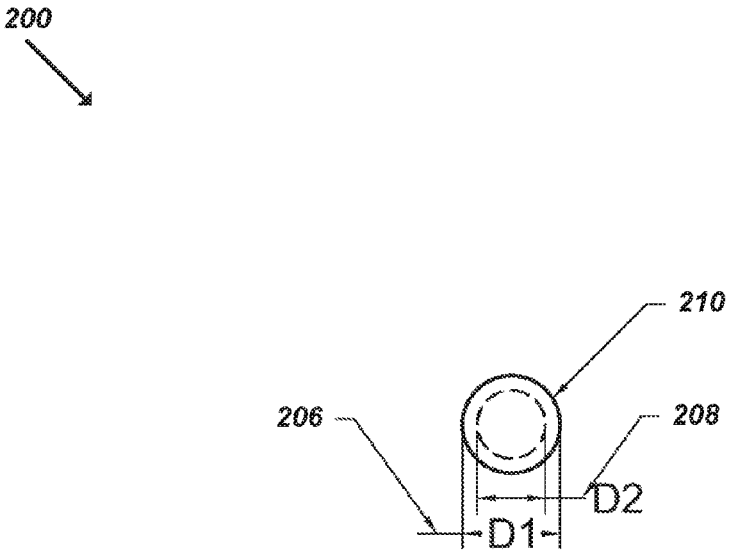
FIG. 2B shows a top plan view of the plug of FIG. 2A.

FIG. 2A and FIG. 2B depict two views of a preferred embodiment of a substantially cylindrical plug 200 included in the stopper shown in FIG. 1A. The plug 200 comprises a blind hole having a first depth along an axial direction 216 of the plug 200 parallel to the axial direction 120, thereby defining a plug inner surface 214 having a plug inner diameter D2 at 208 and a plug inner height L2 at 202, a plug outer surface 210 having a plug outer diameter D1 at 206 and a plug outer height L1 at 204, and a plug base 212 having a plug thickness 218.

In a preferred embodiment of the plug 200, the plug outer diameter 206 is equal to or greater than an inner diameter of the inner surface of the mouth 114. As such, the plug 200 exerts a small, if any, radial pressure against the inner surface of the mouth 114. In a preferred embodiment, the inner height 202 of the plug 200 is equal to or greater than the guide height L10 at 510, shown in more detail in FIG. 5. In a preferred embodiment, the plug 200 is made from cork material.

FIG. 3A-FIG. 3D depict several views of a preferred embodiment of a substantially cylindrical nut 300 included in the stopper shown in FIG. 1A. The nut 300 comprises a nut outer surface 318 having a nut outer diameter D3 at 304, a nut height L3 at 308, and a nut inner surface 320. The nut inner surface 320 is threaded along the axial direction 216. The nut 300 comprises grooves 314 along the axial direction 216. In this preferred embodiment, the nut 300 comprises five grooves 314. The grooves 314 define five protrusions 322 of thickness 324.

Figure 3A:
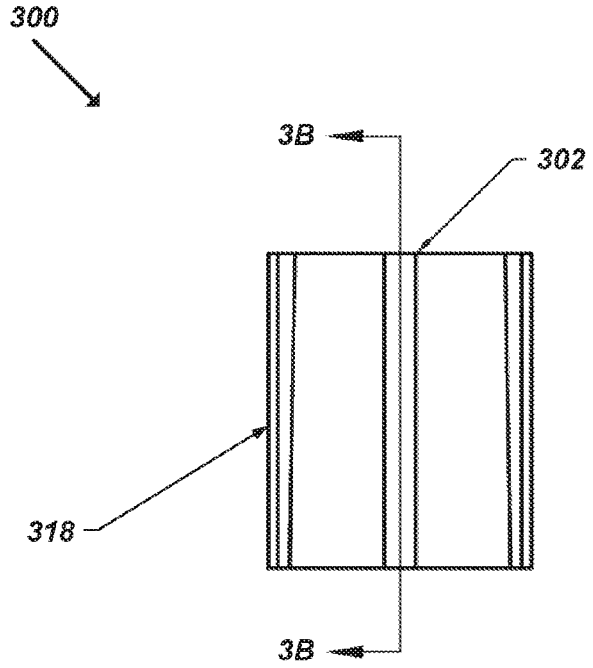
FIG. 3A shows a front elevation view of a preferred embodiment of a nut included in the stopper shown in FIG. 1A.
Figure 3B:
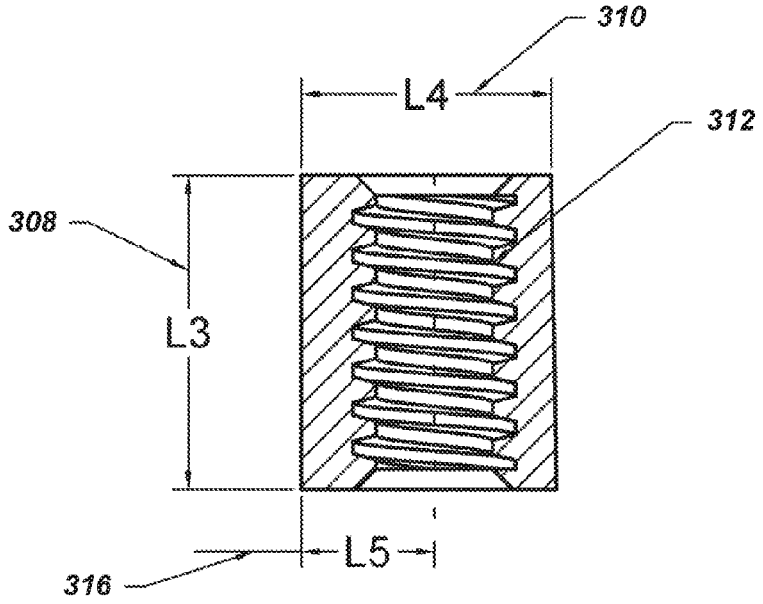
FIG. 3B shows a section view of the nut of FIG. 3A.
Figure 3C:
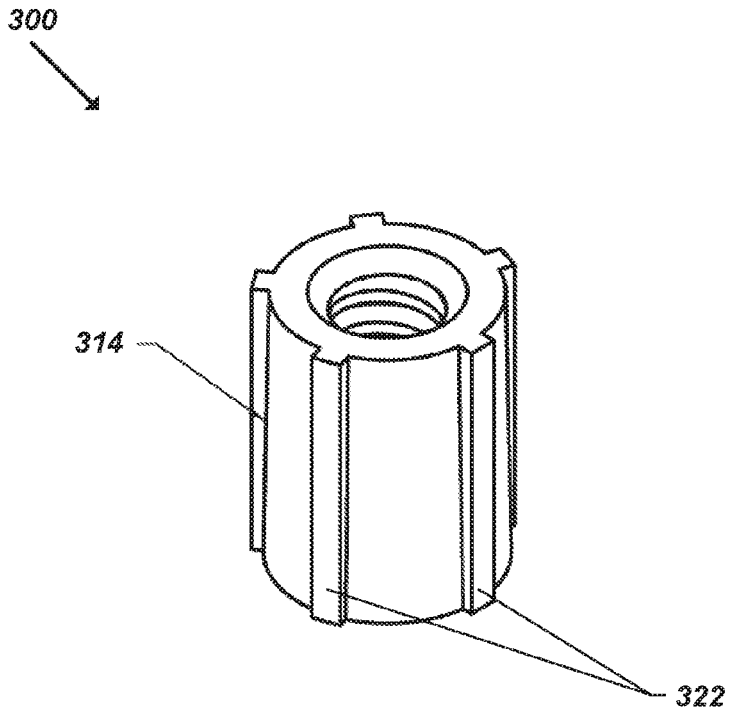
FIG. 3C shows a perspective view of the nut of FIG. 3A.
Figure 3D:
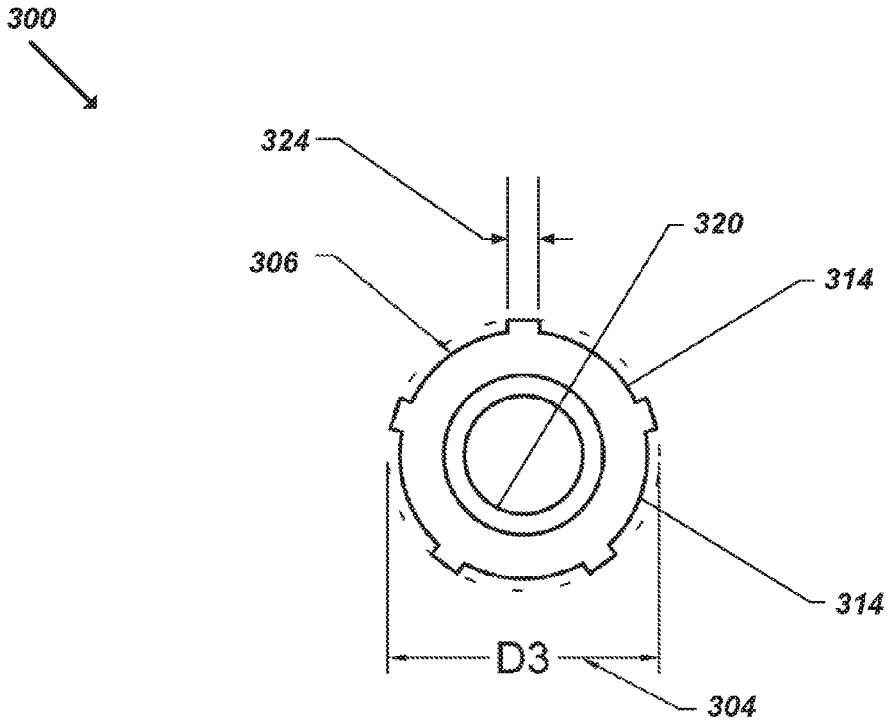
FIG. 3D shows a top plan view of the nut of FIG. 3A.

Section 3B-3B in FIG. 3A depicts a cross sectional view of the nut 300. The inner surface 320 of the nut 300 is threaded at 312 along the nut height 308. The length L4 at 310 is the distance from the groove surface to the nut outer surface 318. The length L5 at 316 is the distance from the center line of the nut 300 to the nut outer surface 318. As discussed in more detail below in connection with a guide 500 shown in FIG. 5A-FIG. 5F, the nut 300 operates to engage the tapered inner surface of the guide 500 via its grooves 314 moving upwardly and downwardly in the axial direction 216 thereby expanding and contracting the guide prongs 512.

Figure 4A:
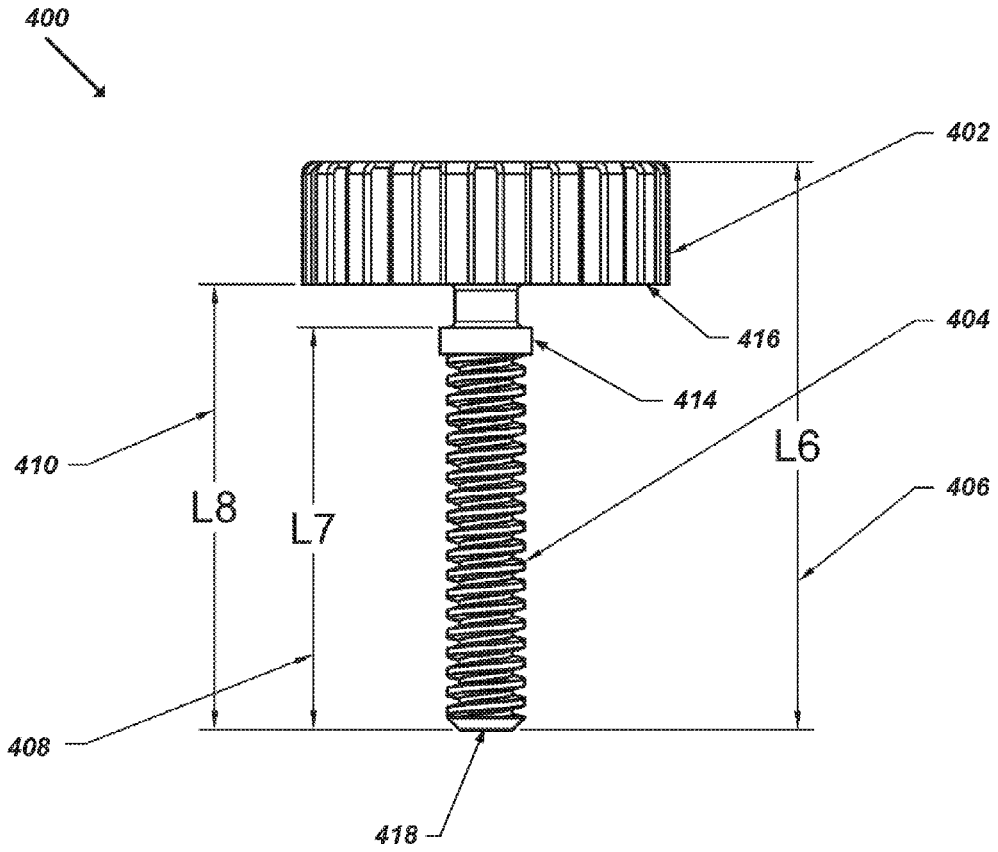
FIG. 4A shows a preferred embodiment of a knob included in the stopper shown in FIG. 1A.
Figure 4B:
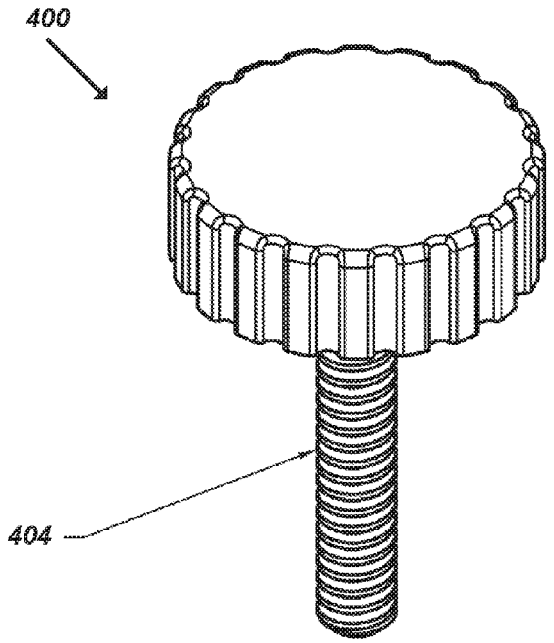
FIG. 4B shows a perspective view of the knob of FIG. 4A.
Figure 4C:
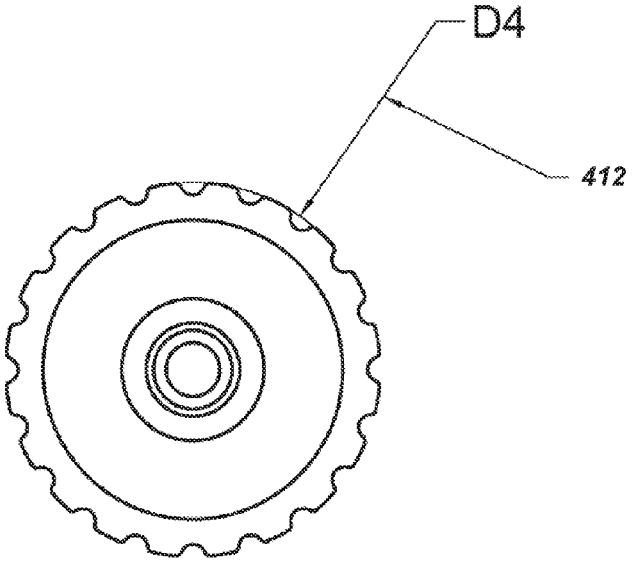
FIG. 4C shows a bottom plan view of the knob of FIG. 4A.
Figure 5A:
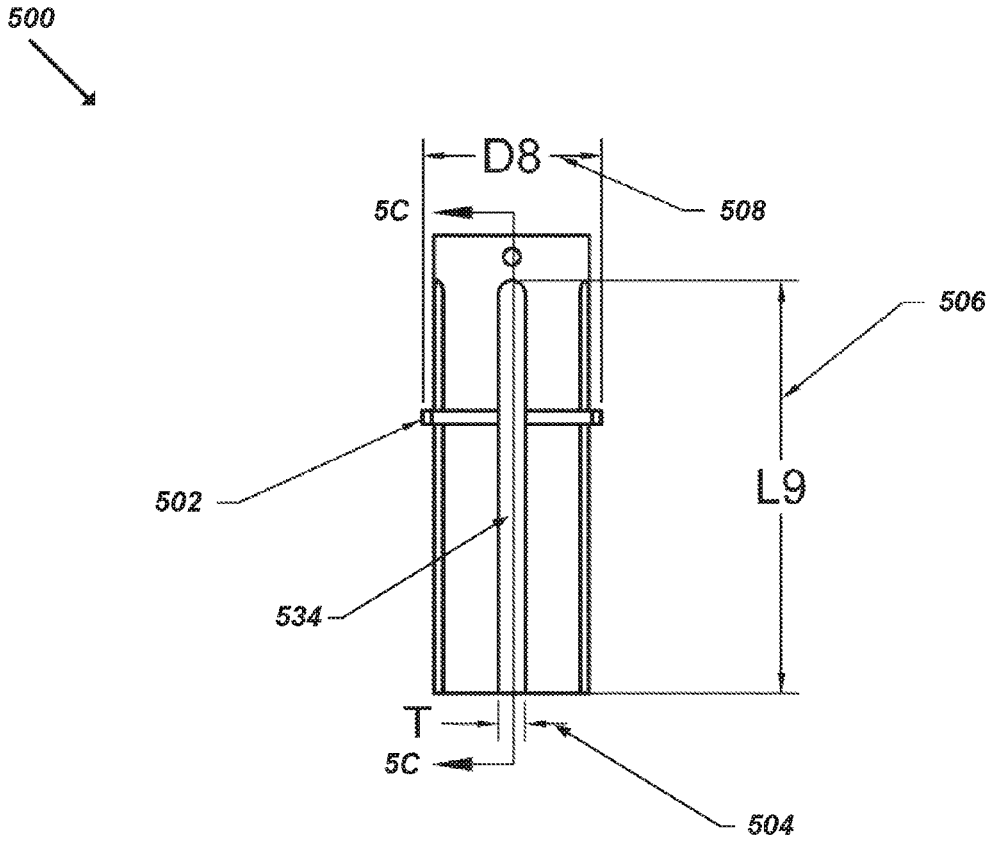
FIG. 5A shows a front elevation view of a preferred embodiment of a guide included in the stopper shown in FIG. 1A.
Figure 5B:
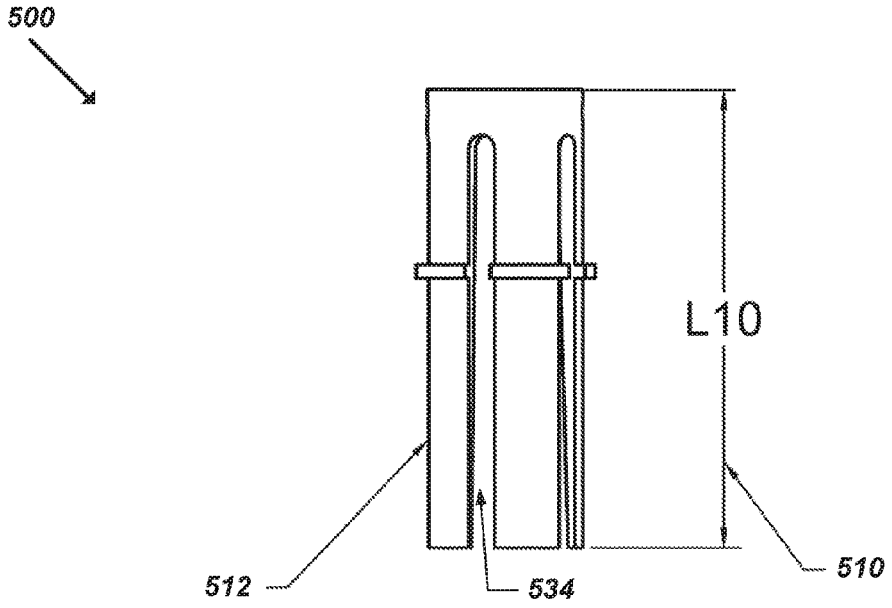
FIG. 5B shows a rotated front elevation view of the guide of FIG. 5A.
Figure 5C:
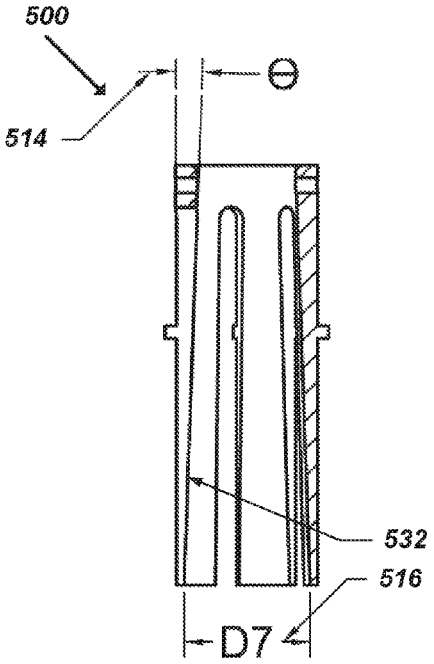
FIG. 5C shows a section view of the guide of FIG. 5A.
Figure 5D:
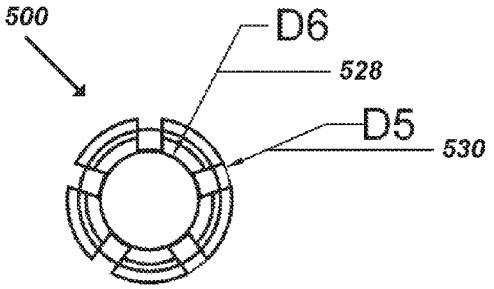
FIG. 5D shows a top plan view of the guide of FIG. 5A.
Figure 5E:
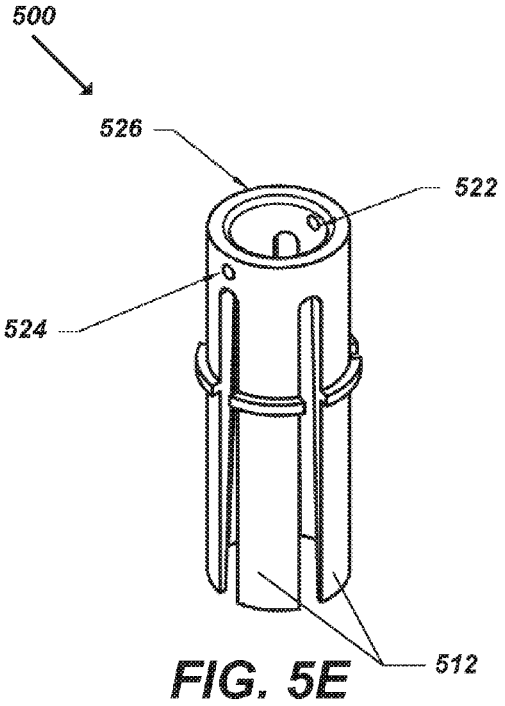
FIG. 5E shows a top perspective view of the guide of FIG. 5A.
Figure 5F:
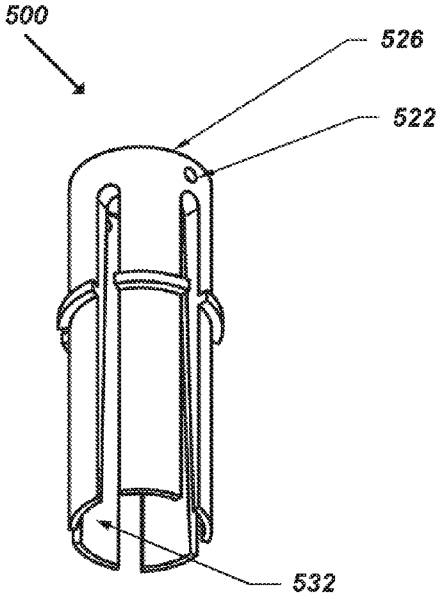
FIG. 5F shows a bottom perspective view of the guide of FIG. 5A.

FIG. 4A-FIG. 4C depict three views of a preferred embodiment of a substantially cylindrical knob 400 included in the stopper shown in FIG. 1A. The knob 400 comprises a threaded bolt 404 having a bolt height L7 at 408. In this preferred embodiment, the knob 400 has a gnarly top 402 having an outer surface of diameter D4 at 412 and a base 416 situated a length L8 at 410 from the bottom 418 of the threaded bolt 404. In one preferred embodiment, the diameter 412 of the knob 400 is equal to an outer diameter of the mouth 114 of the container 116.

The top 402 is where a user's fingers engage the knob 400 to turn it in either circumferential direction 122, thereby, moving the nut 300 up and down along the axial direction 216, causing tightening and loosening of the stopper assembly inside the mouth 114 of the container 166 shown in FIG. 1A. The annular region between the top of a collar 414 of the threaded bolt 404 and the base 416 of the gnarly top 402 is provided for setscrews 104 and 106 so that the knob 400 and the guide 500 move together as a rigid body along the axial direction 120 while allowing the knob 400 to freely rotate in either circumferential direction 122 inside the guide 500.

FIG. 5A-FIG. 5F depict several views of a preferred embodiment of a substantially tubular guide 500 included in the stopper shown in FIG. 1A. The guide 500 comprises a guide outer surface 526 having a guide outer diameter D5 at 530, a guide height L10 at 510, and a guide inner surface 532. The guide inner surface 532 is tapered along the axial direction 216 at an angle 8 at 514. Specifically, diameter D7 at 516 of the guide 500 decreases linearly as a function of distance along the axial direction 216 to diameter D6 at 528. The guide 500 comprises five slits 534 having a second depth L9 at 506 and thickness 504, thereby, defining five guide prongs 512. These five prongs 512 will engage the five grooves 314 of the nut 300.

In this preferred embodiment, the guide 500 comprises two threaded holes 522 and 524 where setscrews 104 and 106 can be screwed into the guide, thereby, securing the knob 400 to the guide 500 so that the knob 400 and the guide 500 move together as a rigid body along the axial direction 216, while allowing the knob 400 to freely rotate inside the guide 500 in either circumferential direction 122 inside the guide 500. The outer surface 526 of the guide 500 further comprises a circumferential ridge 502 having a diameter D8 at 508 along the axial direction 216. According to one preferred embodiment, the guide 500 is molded in the plug 200. In one preferred embodiment, the guide outer diameter 530 is equal to or less than the inner diameter 206 of the plug 200. In one preferred embodiment, the bolt height 408 is equal to the guide height 510. The guide can be made from a variety of materials including aluminum and steel.

Referring to FIGS. 1 thru 5, one embodiment of the operation of the stopper mechanism is now described. The nut 300 is inserted inside the blind hole of the plug 200. The guide 500 is inserted inside the plug 200 and the knob 400 is inserted inside the guide 500 where the knob threaded bolt 404 engages the threaded surface 312 of the nut 300. This subassembly is inserted into the mouth 114 of the container 116. The outer diameter 206 of the outer surface 210 of the plug 200 is slightly larger than the inner diameter of the mouth 114 producing an initial sealing pressure when the stopper is inserted into the mouth 114. As the knob 400 is rotated, for instance in the clockwise direction, the nut 300 moves upward along the axial direction 120. The guide prongs 512 engage the nut grooves 314 and the protrusions 322 move inside the slits 534. Because the inner surface 532 of the guide 500 is tapered along the axial direction 120, the nut 300 causes the guide prongs 512 to expand which increase the radial pressure caused by the plug 200 against the mouth 114. As the knob 400 is rotated counterclockwise, the nut 300 moves down along the axial direction 120 and the guide prongs 512 contract which decrease the radial pressure, thereby facilitating easy removal of the stopper from the container 116 without the need for any external opener device.

The foregoing explanations, descriptions, illustrations, examples, and discussions have been set forth to assist the reader with understanding this invention and further to demonstrate the utility and novelty of it and are by no means restrictive of the scope of the invention. It is the following claims, including all equivalents, which are intended to define the scope of this invention.

What is claimed is:

1. A bottle stopper comprising:

a cylindrical guide having a plurality of slits that run parallel to a center axis along a portion of the cylindrical guide;

a cylindrical nut that is able to move along the center axis, the cylindrical nut comprising a plurality of ridges, each ridge from the plurality of ridges engaging a particular slit from the plurality of slits such that the cylindrical nut is not able to rotate relative to the cylindrical guide about the center axis;

a knob coupled to a threaded bolt; and a set screw that secures the knob relative to the cylindrical guide such that the cylindrical guide and the knob move together as a rigid body along the center axis, wherein the threaded bolt is able to engage the cylindrical nut such that the cylindrical nut is moved along the center axis when the knob is rotated about the center axis.

2. The bottle stopper of claim 1 further comprising a cylindrical plug able to engage a mouth of a bottle in order to seal the bottle, wherein the cylindrical guide is able to fit within an inner diameter of the cylindrical plug.

3. The bottle stopper of claim 2, wherein the cylindrical guide further comprises a circumferential ridge that secures the cylindrical guide to the cylindrical plug such that the cylindrical guide and the cylindrical plug move as a rigid body along the center axis.

4. The bottle stopper of claim 2, wherein the cylindrical plug comprises cork.

5. The bottle stopper of claim 1, wherein the cylindrical guide comprises a tapered inner surface.

6. The bottle stopper of claim 1, wherein the threaded bolt comprises a collar able to retain the knob relative to the set screw along the center axis.

7. The bottle stopper of claim 1, wherein rotating the knob in a clockwise direction increases sealing pressure and rotating the knob in a counterclockwise direction decreases sealing pressure.

8. A method of sealing a container, the method comprising:

inserting a cylindrical plug into a mouth of the container;

inserting a stopper into the cylindrical plug, the stopper comprising a knob, a threaded bolt, a tapered guide having a center axis, and a nut;

wherein the knob is coupled to the threaded bolt that is able to engage the nut such that the nut is moved along the center axis when the knob is rotated about the center axis; and rotating the knob in a first direction such that the nut is moved along the center axis of the tapered guide and a specified sealing pressure is attained, wherein the stopper further comprises a set screw that secures the knob relative to the tapered guide such that the tapered guide and the knob move together as a rigid body along the center axis.

9. The method of claim 8 further comprising:

rotating the knob in a second direction that is opposite the first direction such that the nut is moved along the center axis of the tapered guide and a specified removal pressure is attained;

removing the stopper; and removing the cylindrical plug.

10. The method of claim 8, wherein the cylindrical plug comprises cork.

11. The method of claim 8, wherein:

the tapered guide comprises a plurality of prongs extending along the center axis; and the nut comprises a plurality of grooves that engage the plurality of prongs and prevent the nut from rotating relative to the tapered guide.

12. The method of claim 8, wherein the tapered guide comprises a circumferential ridge that secures the tapered guide to the cylindrical plug such that the tapered guide and the cylindrical plug move as a rigid body along the center axis.

13. The method of claim 8, wherein the set screw engages a collar on the threaded bolt able to retain the knob relative to the set screw along the center axis.

14. The method of claim 13, wherein the nut comprises a threaded inner surface that is able to accept the threaded bolt.

15. A mechanical container stopper comprising:

a cylindrical plug able to engage a mouth of a container, the cylindrical plug having a center axis;

a tapered guide that fits within the cylindrical plug;

a cylindrical nut that is able to move along the center axis;

a knob coupled to a threaded bolt that is able to engage the cylindrical nut; and a pair of set screws that engage a collar of the threaded bolt in order to prevent the knob from moving along the center axis.

16. The mechanical container stopper of claim 15 further comprising a nut retention element that prevents the cylindrical nut from rotating relative to the tapered guide.

17. The mechanical container stopper of claim 16, wherein the nut retention element comprises a set of grooves along an outer surface of the cylindrical nut and an associated set of prongs on the tapered guide that engage the set of grooves.

18. The mechanical container stopper of claim 17, wherein the tapered guide comprises a ridge that secures the tapered guide to the cylindrical plug such that the tapered guide and the cylindrical plug move as a rigid body along the center axis.

19. The mechanical container stopper of claim 18, wherein the set of grooves includes five grooves and the set of prongs includes five prongs.

20. The mechanical container stopper of claim 19, wherein rotating the knob in a clockwise direction increases sealing pressure and rotating the knob in a counterclockwise direction decreases sealing pressure.

21. The mechanical container stopper of claim 20, wherein the cylindrical plug comprises cork.

* * * * *